US007313878B2

(12) United States Patent
Clegg

(10) Patent No.: US 7,313,878 B2
(45) Date of Patent: Jan. 1, 2008

(54) ROTARY POP-UP ENVELOPE

(76) Inventor: Tim Clegg, 19220 S. Normandie Ave., Torrance, CA (US) 90502-1011

( * ) Notice: Subject to any disclaimer, the term of this patent is extended or adjusted under 35 U.S.C. 154(b) by 387 days.

(21) Appl. No.: 10/983,047

(22) Filed: Nov. 5, 2004

(65) Prior Publication Data

US 2006/0096138 A1 May 11, 2006

(51) Int. Cl.
*G09F 1/00* (2006.01)

(52) U.S. Cl. ..... 40/124.08; 446/152; 446/151; 446/148; 446/147

(58) Field of Classification Search ..... 40/124.08; 446/152, 151, 148, 147; 434/404, 405
See application file for complete search history.

(56) References Cited

U.S. PATENT DOCUMENTS 1,563,548 A * 12/1925 Brashear, Jr. ..... 446/152
2,384,661 A * 9/1945 Wehr ..... 446/152
2,384,662 A * 9/1945 Wehr ..... 446/152
2,522,875 A * 9/1950 Kennedy ..... 446/152
2,884,724 A * 5/1959 Lohnes et al. ..... 446/151
3,946,508 A * 3/1976 Booras ..... 40/124.06
5,799,424 A * 9/1998 Volkert et al. ..... 40/124.08

* cited by examiner

*Primary Examiner*—Katherine Mitchell
*Assistant Examiner*—Marcus Menezes
(74) *Attorney, Agent, or Firm*—Clement Cheng, Esq.

(57) ABSTRACT

A rotary pop-up envelope is disclosed. The device comprises an envelope that holds a pullout tab that is pivotably connected to a pop-up sheet member. The envelope includes a slotted panel with a slot through which the pop-up sheet member is inserted. The envelope further includes a middle panel and a cover panel that, when folded together, enclose the slotted panel, the pop-up sheet member, and the pullout tab. The envelope is open at one end and partially open at a top edge such that when the pullout tab is pulled away from the envelope, the pop-up sheet member engages an apex of the slot in the slotted panel that forces the pop-up sheet member to rotate up through the open portion at the top side of the envelope.

15 Claims, 2 Drawing Sheets

FIG. 1
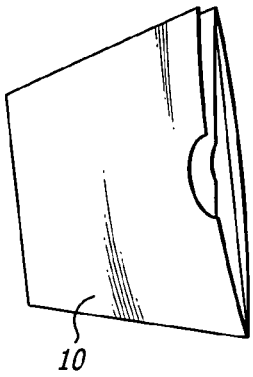
FIG. 2
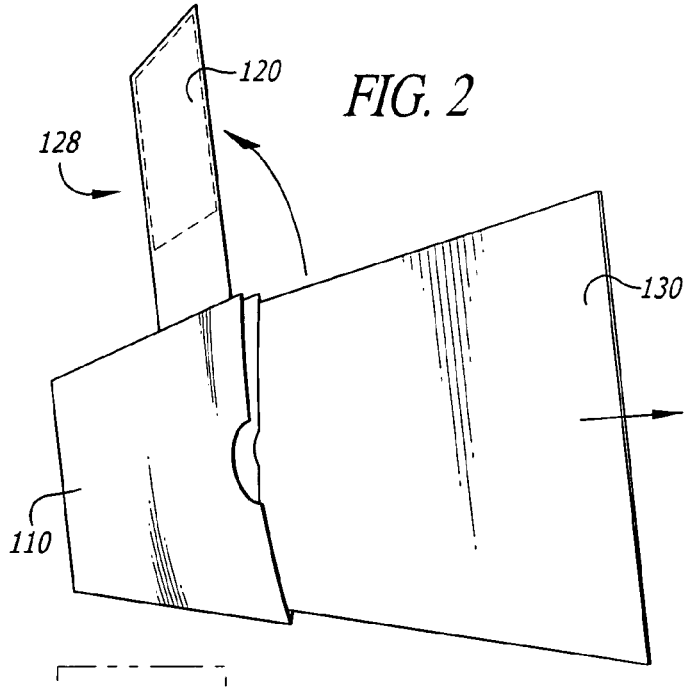
FIG. 3
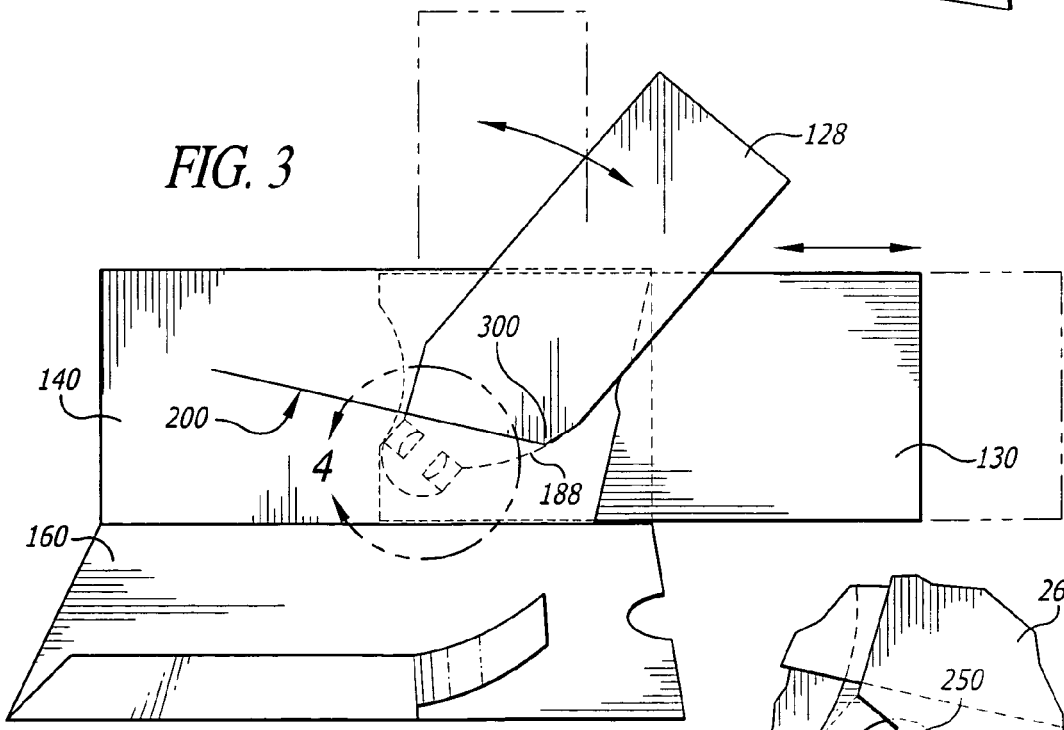
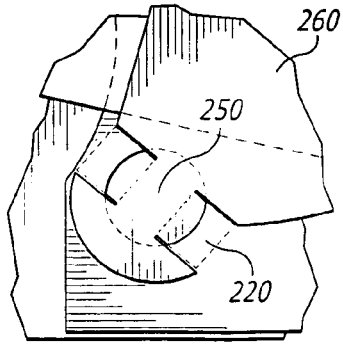
FIG. 4

ROTARY POP-UP ENVELOPE

FIELD OF THE INVENTION

The present invention relates generally to promotional mailers, and, more particularly, to an envelope with a pop-up panel for displaying a promotional or other message.

DISCUSSION OF RELATED ART

In the field of direct marketing, nothing is more important than enticing a recipient of a direct marketing piece to actually open the piece and see what is inside. Usually such enticement is in the form of a printed message on the outside of the envelope, with a message about saving money or some other incentive. Other times a marketer will put nothing on the outside of the envelope that would give any indication as to the source of the mailing, a technique that relies on generating curiosity within the recipient as to what might be inside the envelope. Similarly, offers will sometimes appear to be overtly valuable, such as including a promising marketing piece resembling a bank draft visible beneath the window of the envelope, perhaps even going so far as to print in a visible way "Pay to the order of" along with the recipient's name and address.

All of these techniques have met with some amount of success at increasing the response rate of direct mail campaigns. I have found, however, that novelty and generating curiosity within the recipient tends to generate superior response, merely because the recipient desires to know how something works. For example, U.S. Pat. No. 6,279,739 to Moore et al. on Aug. 28, 2001, teaches a compact disc display and mailing package. Such a device, when opened, displays and "pops-up" a CD or CD-ROM that is fully conceals when the device is in its closed position. Such a device generates a positive response because, not only is it entertaining to use and to understand in terms of the way it works, it promotes "pass along" responses since the recipients many times share the device with friends or colleagues. While such a device is well-suited to offers that involve a CD or CD-ROM, such as marketing campaigns for Internet Service Providers or the like, such a mailer is too expensive for most uses. Further, CDs or CD-ROMs are only rarely used in promotional mailings due to their expense and limited use.

One drawback of the -739 device, however, is that when closed it appears to contain a CD-ROM, but it does nothing more to generate curiosity. The fact that it is a "pop-up" CD display when opened is not evident when the device is closed, unless a message to that effect is printed on the outside of such a package.

Thus, a low-cost mailing envelope for use with a printed offer is desired. Such a needed device would be relatively easy to print, assemble, and mail. Further, such a needed device would have an interactive component that generates curiosity in the user, and entices the user to, at a bear minimum, open the envelope by tearing away a seal or the like and activating the device. The promise of some kind of novel feature or inner workings would be evident with the needed device, even when the device was fully sealed in its closed state. Such a needed device would be substantially flat when in a closed, folded position, and would be suitable for mailing in high volumes without impeding postal sorting and mail processing equipment. The present invention accomplishes these objectives.

SUMMARY OF THE INVENTION

The present device is a rotary pop-up envelope comprising an envelope that holds a pullout tab that is pivotably connected to a pop-up sheet member. The envelope includes a slotted panel with a slot through which the pop-up sheet member is inserted. The envelope further includes a middle panel and a cover panel that, when folded together, enclose the slotted panel, the pop-up sheet member, and the pullout tab. The envelope is open at one end and partially open at a top edge such that when the pullout tab is pulled away from the envelope, the pop-up sheet member engages the apex of the slot in the slotted panel that forces the pop-up sheet member to rotate up through the open portion at the top side of the envelope. The device is in its fully extended position when the longitudinal axis of the pop-up sheet member forms generally a right angle with the longitudinal axis of the pullout tab.

The pop-up sheet member has at one end a pop-up message, which may include a detachable coupon or the like. An opposing bottom portion of the pop-up sheet member includes a pivot means, such as a rotational insert, that provides for rotational attachment of the pop-up sheet member to the pullout tab. A pull grove is included at an open end of the envelope so as to facilitate the grasping of the pullout tab when the pullout tab is fully inserted in the envelope.

An adhesive closure seal or tear-away section may be attached around the open end of the envelope to keep the device in its retracted position during transit.

The present device provides for an eye-catching means of delivering a promotional message through the mail. The device is relatively inexpensive to print and assemble, and a wide variety of promotional or other messages may be included on such a device. The present device is suitable for handling by high-speed automated postal equipment, that is, it will not jam or otherwise impede such equipment. Further, with an adhesive seal folded around the open end of the envelope of the device, the device will remain in its retracted position until the recipient removes the adhesive seal. Other features and advantages of the present invention will become apparent from the following more detailed description, taken in conjunction with the accompanying drawings, which illustrate, by way of example, the principles of the invention.

DESCRIPTION OF THE DRAWINGS

FIG. 1 is a perspective view of the invention, illustrating a pop-up envelope in a retracted position suitable for mailing;

FIG. 2 is a perspective view of the invention, illustrating the pop-up envelope with a pop-up panel and a pullout tab in an extended position;

FIG. 3 is a partial cut-away view of the invention, illustrating the pop-up panel and the pullout tab in a partially extended position, and, in outline, in a fully extended position;

FIG. 4 is a close-up view of a pivot means of the invention, taken generally along lines 4-4 of FIG. 3.

DETAILED DESCRIPTION OF THE PREFERRED EMBODIMENT

Figure 5:
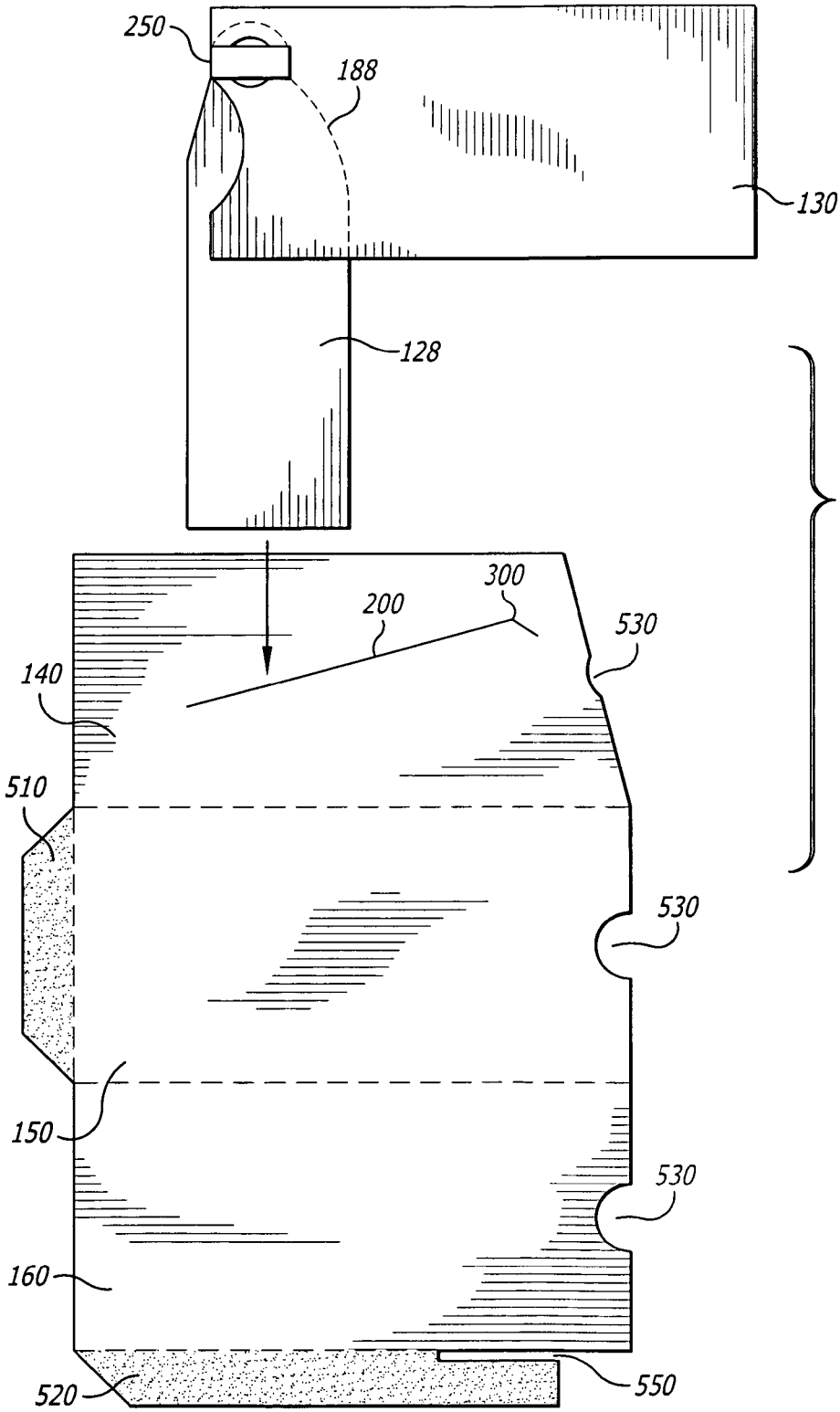
FIG. 5 is an exploded view of the invention, illustrating the assembly of the pop-up panel with an envelope of the invention.

The present invention is a rotary pop-up envelope 10 comprising an envelope 110 that holds a pullout sheet tab 130 pivotably connected to a pop-up sheet member 128 (FIGS. 1 and 2). The envelope 110 includes a slotted panel 140 that includes a slot 200 formed therein, a middle panel 150, and a cover panel 160, the middle panel 150 being foldably connected to the slotted panel 140 and the cover panel 160 (FIG. 5). The middle panel 150 further includes at one end a closure flap 510. The cover panel 160 further includes a cover panel closure tab 520, the tab 520 further including a tab slot 550 extending partially between the cover panel 160 and the tab 520. The tab slot 550 forms an exit slot for the pop up to protrude from the envelope The entire device can be made of paper. Preferably the pop-up sheet member 128, the pullout tab 130, and the envelope 110 are all formed from a suitable paper stock, such as a card stock. Alternatively, for increased durability, the sheet and panel material may be a thin sheet of plastic or other suitable polymer. In either case, the material must readily accept standard offset printing inks or photocopier toner.

The pop-up sheet member 128 includes at one end a pop-up message 128, which may include a detachable coupon or the like (not shown). An opposing bottom portion 260 of the pop-up sheet member 128 includes a pivot means 220 (FIG. 4), such as a rotational insert, that provides for rotational attachment of the pop-up sheet member 128 to the pullout tab 130. Preferably the pivot means 220 is accomplished by forming slots and tabs in the pullout tab 130 and the pop-up sheet member 128 respectively, so that the pivot means 220 remains relatively thin and unobtrusive to postal sorting equipment, and the like. It has been found that rivets or other relatively bulky pivot means less suitable for high-speed postal equipment, to which the present device 10 would be subjected when mailed.

A pull grove 530 is included at an open end of the middle panel 150, the slotted panel 140, and the cover panel 160 such that when panels 140, 150, 160 are folded together and aligned, their respective pull groves 530 are also aligned (FIG. 1). The grooves 530 facilitate the grasping of the pullout tab 130 when the pullout tab 130 is fully inserted between the panels 140,150.

During assembly, the pop-up sheet member 128 is inserted into slot 200 as shown in FIG. 5. Once the pullout tab 130 is aligned with the slotted panel 140, the pullout tab 130 and slotted panel 140 are folded down into alignment with the middle panel 150. The middle panel closure tab is then folded over the slotted panel 140 and adhered with any suitable adhesive means, such as double-sided tape or glue (not shown). The cover panel 160 is then folded up into alignment with the slotted panel 140 and the middle panel 150, and the cover panel closure tab 520 is folded up around the fold of the slotted panel 140 and the middle panel 150. The closure tab 520 is then adhered to the back side of the middle panel 150 with any suitable adhesive means, such as double-sided tape or glue (not shown).

In use, the device 10 provides for two primary positions of the pop-up sheet member 128, namely, a retracted and an extended position. The retracted position, illustrated in FIG. 1, embodies the pullout tab 130 fully inserted between the slotted panel 140 and the middle panel 150. An adhesive seal (not shown) may be folded over the pull grooves 530 or otherwise folded over the exposed end of the pullout tab 130 to keep the device 10 in the retracted position during transit. Alternatively, the panels 140, 150, 160 may all include an extended perforated section that glues together (not shown), such that the recipient may simply tear off the extended perforated sections as a unit to reveal the pull tab. Such a method is easier to open as it simply requires a small degree of manual force applied along the perforations to separate the extended section from the remaining portion of the envelope 110. With an adhesive seal, a cutting instrument such as a pocketknife or scissors may be required in order for the recipient to sever the seal or otherwise remove it; however, a small adhesive seal may be less expensive to use than the extended perforated sections.

In the retracted position, the pop-up sheet member 128 is engaged in the slot 200 and fully enclosed between the middle panel 150 and the cover panel 160. The slot 200 includes a slot apex 300 at one side thereof. To position the device 10 in the extended position, illustrated in FIG. 2, a user grasps the pullout tab 130 where exposed by the pull groves 530 and pulls the pullout tab 130 away from the envelope 110. As the pullout tab 130 is pulled away from the envelope 110 (FIG. 3), the apex 300 of the slot 200 engages a lead edge 188 of the pop-up sheet member 128, forcing the pop-up sheet member 128 to pivot around the rotational axis 150 of its pivoting attachment means 220. The shape of the leading edge 188 may be varied, smooth, or of various shapes to cause either a quick, slow, or irregular extension of the pop-up sheet member 128 as the pullout tab 130 is pulled away from the envelope 110 in a uniform manner. It is preferred to have the pop up engaging lead edge shaped to provide a constant rotational displacement for a constant pull on the pullout sheet tab. When the pop-up sheet member 128 is at generally a right angle to the pullout tab 130, the pop-up sheet member 128 contacts the cover panel closure tab 520 that prevents further rotation of the pop-up sheet member 128. As such, the device is in the fully extended position as shown in FIG. 2.

The device retracts when the user pushes the pullout 130 into the envelope 110, which pulls the pop member sheet 128 back into the envelope.

While a particular form of the invention has been illustrated and described, it will be apparent that various modifications can be made without departing from the spirit and scope of the invention. For example, the exact mode of the pivot means 220 may be changed in a variety of ways known in the prior art, but still produce the effect of pivotably attaching the pop-up sheet member 128 to the pullout tab 130. Likewise, the means for adhering the closure tabs 510, 520 may be any one of a number of suitable attachment means other than double-sided tape or glue, such as staples or clips or the like. Accordingly, it is not intended that the invention be limited, except as by the appended claims.

The invention claimed is:

1. A rotary pop-up envelope comprising:

an envelope holding a pullout sheet tab connected by a swivel pivot to a pop-up sheet member;

a slot holding the pop up sheet member and having a slot apex;

a pop up engaging lead edge formed on the pop up sheet member;

wherein the pop up engaging lead edge engages the slot apex rotating the pop-up sheet member to protrude from the enveloping when the pullout sheet tab is pulled away from the envelope;

a cover panel closure tab folded up around a slotted panel and a middle panel, wherein the pop-up sheet member contacts the cover panel closure tab that prevents further rotation of the pop-up sheet member when in the fully extended position.

2. A rotary pop-up envelope comprising:

an envelope formed from three panels, the envelope holding a pullout sheet tab connected by a pivot means to a pop-up sheet member, a leading edge formed on the pop up sheet member;

a slot holding the pop up sheet member;

wherein the lead edge engages a slot apex, thereby rotating the pop-up sheet member to extend laterally from the enveloping when the pullout sheet tab is pulled away from the envelope;

wherein the envelope is formed of three folded panels: a slotted panel formed on the envelope that includes the slot formed therein, a middle panel connected to the slotted panel, and a cover panel, wherein the middle panel is foldably connected to the slotted panel and the cover panel;

wherein the middle panel further includes at one end a closure flap and the cover panel further includes a cover panel closure tab that has a tab slot extending partially between the cover panel and the tab.

3. The rotary pop-up envelope of claim 2, wherein the pop up engaging lead edge is shaped to provide a constant rotational displacement for a constant pull on the pullout sheet tab.

4. The rotary pop-up envelope of claim 2, wherein the pop-up sheet member is at generally a right angle to the pullout tab in fully extended position.

5. The rotary pop-up envelope of claim 2, wherein the entire device is made of paper.

6. The rotary pop-up envelope of claim 2, wherein the pop up lead edge is shaped to provide a constant rotational displacement for a constant pull on the pullout sheet tab.

7. The rotary pop-up envelope of claim 2, wherein the pop-up sheet member is at generally a right angle to the pullout tab in fully extended position.

8. A rotary pop-up envelope comprising:

an envelope formed from three panels, the envelope holding a pullout sheet tab connected by a pivot means to a pop-up sheet member, a leading edge formed on the pop up sheet member;

a slot holding the pop up sheet member;

wherein the lead edge engages a slot apex, thereby rotating the pop-up sheet member to extend laterally from the enveloping when the pullout sheet tab is pulled away from the envelope;

a cover panel closure tab folded up around a slotted panel and a middle panel, wherein the pop-up sheet member contacts the cover panel closure tab that prevents further rotation of the pop-up sheet member when in the fully extended position.

9. A rotary pop-up envelope comprising:

an envelope;

a pullout sheet tab slidably disposed within the envelope;

a pop-up sheet member pivotally attached to the pullout sheet tab, the pop-up sheet having a leading edge;

a slot formed on the envelope retaining the pop up sheet member, a slot apex formed on the slot so that the leading edge frictionally engages the slot apex, wherein the pop-up sheet member rotates to pop-up from the envelope when the pullout sheet tab is pulled;

wherein the middle panel further includes at one end a closure flap and the cover panel further includes a cover panel closure tab that has a tab slot extending partially between the cover panel and the tab.

10. The rotary pop-up envelope of claim 9, wherein the entire device is made of paper.

11. The rotary pop-up envelope of claim 9, wherein the pop up lead edge is shaped to provide a constant rotational displacement tor a constant pull on the pullout sheet tab.

12. The rotary pop-up envelope of claim 9, wherein the pop-up sheet member is at generally a right angle to the pullout tab in fully extended position.

13. A rotary pop-up envelope comprising:

an envelope;

a pullout sheet tab slidably disposed within the envelope;

a pop-up sheet member pivotally attached to the pullout sheet tab, the pop-up sheet having a leading edge;

a slot formed on the envelope retaining the pop up sheet member, a slot apex formed on the slot so that the leading edge frictionally engages the slot apex, wherein the pop-up sheet member rotates to pop-up from the envelope when the pullout sheet tab is pulled;

further comprising a cover panel closure tab folded up around a slotted panel and a middle panel, wherein the pop-up sheet member contacts the cover panel closure tab that prevents further rotation of the pop-up sheet member when in the fully extended position.

14. The rotary pop-up envelope of claim 13, wherein the pop up engaging lead edge is shaped to provide a constant rotational displacement for a constant pull on the pullout sheet tab.

15. The rotary pop-up envelope of claim 13, wherein the pop-up sheet member is at generally a right angle to the pullout sheet tab in fully extended position.

* * * * *